US008047212B2

(12) United States Patent
Lin

(10) Patent No.: US 8,047,212 B2
(45) Date of Patent: Nov. 1, 2011

(54) EYELASH CURLING APPARATUS

(75) Inventor: Su-Lin Lin, Taipei (TW)

(73) Assignee: Mei-Chi-Na Hsinyen Co., Ltd., Taipei (TW)

( * ) Notice: Subject to any disclaimer, the term of this patent is extended or adjusted under 35 U.S.C. 154(b) by 786 days.

(21) Appl. No.: 12/081,148

(22) Filed: Apr. 11, 2008

(65) Prior Publication Data

US 2009/0255548 A1 Oct. 15, 2009

(51) Int. Cl.
*A45D 2/48* (2006.01)

(52) U.S. Cl. ..... 132/217

(58) Field of Classification Search ..... 132/217, 132/216, 218, 319
See application file for complete search history.

(56) References Cited

U.S. PATENT DOCUMENTS

| | | | | |
|---|---|---|---|---|
| 2,410,391 | A * | 10/1946 | Palmer | 132/217 |
| 5,957,142 | A * | 9/1999 | Karafilis | 132/319 |
| 7,475,690 | B2 * | 1/2009 | Cho | 132/217 |
| 2005/0061347 | A1 * | 3/2005 | Park | 132/217 |

* cited by examiner

*Primary Examiner* — Robyn Doan
(74) *Attorney, Agent, or Firm* — Bacon & Thomas, PLLC

(57) ABSTRACT

An eyelash curling apparatus includes a frame, a curved plate, a movable plate and a latch plate. The frame has a slide slot and a fixing hole on both sides. The curved plate has an insert portion at both ends for fixing the curved plate with the frame. The movable plate has at least one protruding lump corresponding to the slide slot, and can slide on the frame by means of the protruding lumps. The movable plate includes a plurality of transverse partitions with a thickness smaller than the thickness of the movable plate and a plurality of transverse opening each disposed between two adjacent transverse partitions. The movable plate has a clamp pad. If the movable plate is moved along the slide slot, the transverse partitions abuts the curved plate, and the clamp pad abuts the curved plate for curling an eyelash.

2 Claims, 5 Drawing Sheets

EYELASH CURLING APPARATUS

FIELD OF THE INVENTION

The present invention relates to a beauty tool, and more particularly to an eyelash curling apparatus.

BACKGROUND OF THE INVENTION

To make a woman's eyes wider, brighter and more attractive, the woman usually curls her eyelashes by an eyelash clamp to make the eyelashes look denser and finer and the eyes look brighter. After a consumer clamps and presses the eyelashes by the eyelash clamp, the eyelashes are elastically deformed by the clamping force to achieve the curling effect. Since the eyelashes are affected by their restoring elasticity and the gravitational force, the curled eyelashes generally droop and return to their original shape within half a day. Consumers have to pay attention to the curled eyelashes and check their eyelashes from time to time to see if the eyelashes are still curled. Furthermore, consumers need to carry the eyelash clamp with them all the time, so that they can maintain the curliness of their eyelashes. Obviously, such arrangement is very inconvenient and time-consuming to the consumers.

To maintain the eyelash to be curled for a long time, some manufacturers develop eyelash mascaras and eyelash brushes for the purpose of curling the eyelashes. If a consumer tries to curl an eyelash by the eyelash clamp, the consumer usually sticks some eyelash mascara to the eyelash brush first, and then evenly applies the eyelash mascara onto the eyelash to make the eyelash look dense and slim, and maintain the eyelash to be curled for a long time. However, the eyelash will become messy and droop if the eyelash mascara is affected and softened by moisture, and thus consumers have to apply the eyelash mascara onto the eyelash again to reinforce the curliness of the eyelash. Obviously, such application is very inconvenient. Before going to bed, consumers can use a piece of cleansing cotton or a cleaning lotion to clean their eyelashes completely, and the remained eyelash mascara may stain the lower eyelid and cause a look of a black eye. Therefore, consumers have to spend extra money for the cleansing cotton or lotion and take time to remove the remained eyelash mascara, and such application definitely requires improvements.

In view of the foregoing shortcomings of the traditional eyelash clamp, eyelash mascara and eyelash brush, manufacturers develop an improved structure of an eyelash clamp as disclosed in R.O.C. Pat. No. M255673 and shown in FIGS. 1 and 2, the improved structure 1 used by a cosmetologist comprises a frame 101, a curved plate 102, a movable plate 103 and a latch plate 104, wherein both sides of the frame 101 separately have a slide slot 105, and the internal periphery of the curved plate 102 and the movable plate 103 is substantially in a concavely curved shape, and both ends of the curved plate 102 are fixed to both left and right sides of the top edge of the frame 101 respectively, and both sides of the movable plate 103 separately have two protruding lumps 106 corresponding to the slide slot 105, and the movable plate 103 can slide on the frame 101 by means of the protruding lumps 106. The movable plate 103 has an open portion 107 extended to a position proximate to an end of the curved plate 102, and the thickness of the open portion 107 is smaller than the thickness of the movable plate 103, and the open portion 107 includes a plurality of openings, and a partition 108 disposed between two adjacent openings. The internal periphery of the partition 108 includes a plurality of ditch lines 109, and the movable plate 103 includes a clamp pad 110 disposed proximate to a position of connecting the open portion 107, such that if the movable plate 103 is moved along the slide slot 105 to a position corresponding to the top edge of both left and right sides of the frame 101, the eyelash will be clamped between the internal surface of the open portion 107 and the external surface of the curved plate 102, and clamped between the upper edge of the clamp pad 110 and the lower edge of the curved plate 102. Further, the latch plate 104 is pivotally coupled to the bottom side of the frame 101 for latching the latch plate 104 with the movable plate 103 to maintain the movable plate 103 at a position corresponding to the top edge of both left and right sides of the frame 101, so as to constitute an improved structure 1 of the eyelash clamp.

If a cosmetologist uses an improved structure 1 of the eyelash clamp to curl a consumer's eyelash as shown in FIGS. 1 and 2, the cosmetologist coats the curling agent onto an internal surface of the open portion 107, such that the eyelash is clamped and fixed between the internal surface of the open portion 107 and the external surface of the curved plate 102, and clamped between an upper edge of the clamp pad 110 and a lower edge of the curved plate 102, such that the curling agent is adhered onto eyelash. The cosmetologist turns the latch plate 104 to press the latch plate 104 at the movable plate 103, so that the clamp pad 110 and the curved plate 102 are maintained at a clamping condition, and then uses a heating tool (such as a hair dryer) to increase the temperature of the curling agent to curl the eyelash. Therefore, the eyelash can be curled and shaped and maintained curled for a long time. Thus, consumers need not to spend extra money for the eyelash mascara, eyelash brush and cleansing lotion for reinforcing the curliness of the eyelash, and the invention can greatly improve the convenience of using the eyelash clamp. However, the distance between the partitions 108 is too small, so that if the cosmetologist coats the curling agent from an external surface of the open portion 107, the curling agent will remain on an external surface of the open portion due to surface tension, and the cosmetologist has to coat the curling agent onto an internal surface of the open portion 107. When the cosmetologist extends the eyelash between the curved plate 102 and the open portion 107, the curling agent may touch the eyes or eyelids and cause allergies to the eyelids or eyeballs. Since the curved plate 102 is fixed to the frame, and the movable plate 103 cannot be removed and replaced, therefore the improved structure 1 of the eyelash curling apparatus cannot fit various different shapes of eye sockets or attach the consumer's eye socket closely. As a result, the curling effect will be affected adversely.

Therefore, it is an important subject for the present invention to design and manufacture an eyelash curling apparatus, such that each component of the eyelash curling apparatus can be replaced freely to fit various shapes of eye sockets, and a direct contact of the curling agent with the eyelids or eyes can be prevented.

SUMMARY OF THE INVENTION

In view of the shortcomings of the eyelash clamp and the eyelash mascara in accordance with the prior art, the inventor of the present invention based on years of experience in the related industry to conduct extensive researches and experiments, and finally developed an eyelash curling apparatus to provide a simple and safe way for curling the eyelashes.

It is a primary objective of the present invention to provide an eyelash curling apparatus, and the eyelash curling apparatus comprises a frame, a curved plate, a movable plate and a latch plate, wherein the frame is substantially in a U-shape and includes a left portion, a bottom portion and a right portion, wherein the left portion and right portion are respectively in a curved shape concavely towards a rear side of the frame and the bottom portion is in a curved shape concavely towards a front side of the frame, and inner sides of the left portion and right portion correspond to each other and have a fixing hole disposed away from the top edge of the bottom portion respectively, the inner sides of the left portion and right portion have a slide slot respectively, and the slide slot includes a latch portion protruded from the slide slot. The curved plate and the movable plate is substantially in a curved shape concavely towards the front side of the frame, and both ends of the curved plate separately have an insert portion corresponding to each respective fixing hole, such that the curved plate can be fixed to the inner sides of the left portion and right portion at a position away from the top edge of the bottom portion, and both ends of the movable plate separately have at least one protruding lump corresponding to the slide slot, so that the movable plate can slide on the frame along the slide slots by means of the protruding lumps. Further, the movable plate includes a plurality of transverse partitions each having a plurality of longitudinal ditch lines disposed on a front surface thereof, a plurality of transverse opening each disposed between two adjacent transverse partitions and extended to positions proximate to both ends of the movable plate, and a clamp pad disposed on the movable plate at a position proximate to a bottom side of the movable plate. The thickness of the transverse partition is smaller than the thickness of the movable plate. If the movable plate is moved along the slide slot to a position corresponding to a rear surface of the curved plate, an upper edge of the clamp pad abuts a lower edge of the curved plate to extend the eyelash between the curved plate and the transverse partitions and fix the eyelash between the front surface of the transverse partitions and the rear surface of the curved plate, such that the eyelash is clamped between an upper edge of the clamp pad and a lower edge of the curved plate. In addition, the latch plate is pivotally coupled to the bottom side of the frame, so that when the movable plate is moved to a position corresponding to the rear surface of the curved plate, the latch plate can be turned and latched to the position of the movable plate to maintain the clamp pad and the curved plate in a clamping condition. The cosmetologist can select a frame, a movable plate and a curved plate with an appropriate curvature to assemble an eyelash curling apparatus in accordance with the present invention to fit the shape of a consumer's eye socket, such that the eyelash curling apparatus can be attached to the consumer's eye socket closely to improve the eyelash curling effect.

Another objective of the present invention is to extend the longitudinal ditch lines of the transverse partitions to both surfaces of the transverse partition proximate to the transverse openings, so that if the cosmetologist coats a curling agent from a rear surface of the transverse partition, the curling agent will pass through the transverse openings, and flow successfully into the longitudinal ditch lines at the front surface of the transverse partition to effectively reduce or eliminate the surface tension of the curling agent with the transverse partitions, and prevent the curling agent from being remained on the rear surface of the transverse partition to adhere the curling agent onto the eyelash successfully. Therefore, the consumers can stick the curling agent onto the eyelash through the longitudinal ditch lines on the front surface of the transverse partition. The invention not only effectively prevents the curling agent from contacting the eyelids or eyeballs directly, but also avoids allergies of an eyelid or eyeball caused by the curling agent. With the longitudinal ditch lines, the eyelashes can be well combed, so that after the cosmetologist uses the curling agent to curl the eyelashes, the consumer's eyelashes can be combed into fine hairs and maintained to be curled for a long time.

To make it easier for our examiner to understand the shape, structure, design principle and performance of the present invention, we use preferred embodiments together with the attached drawings for the detailed description of the invention as follows:

DETAILED DESCRIPTION OF THE PREFERRED EMBODIMENTS

Figure 1:
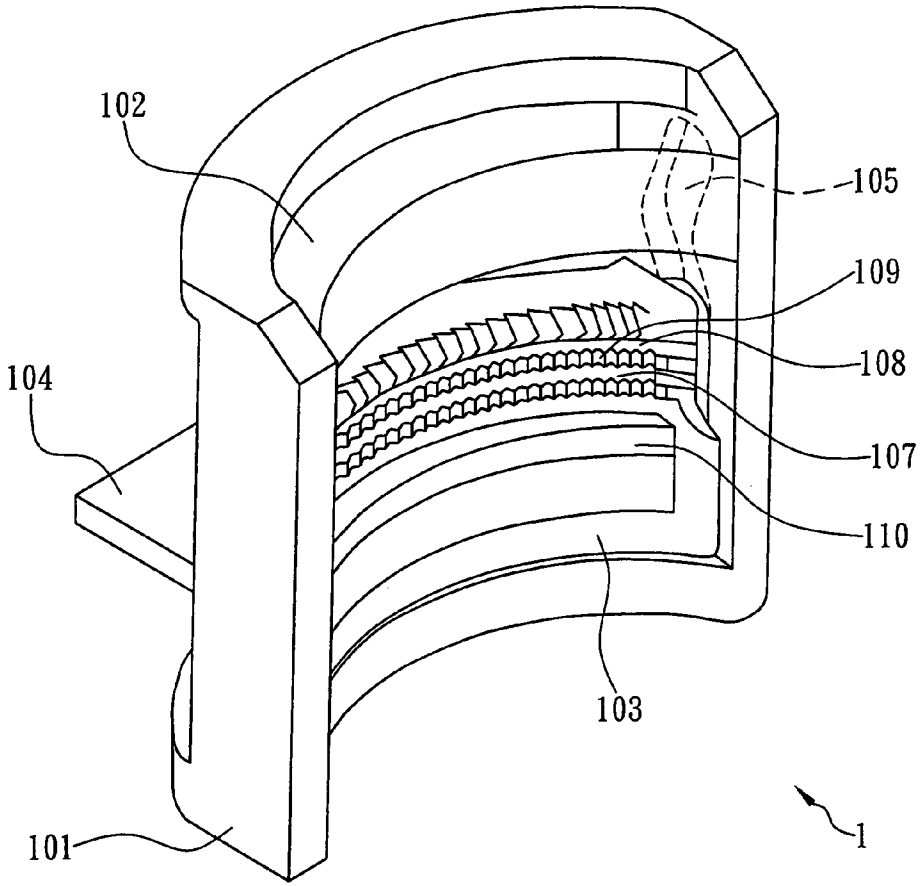
FIG. 1 (Prior Art)
FIG. 1 is a perspective view of an improved structure of an eyelash clamp in accordance with a prior art.
Figure 2:
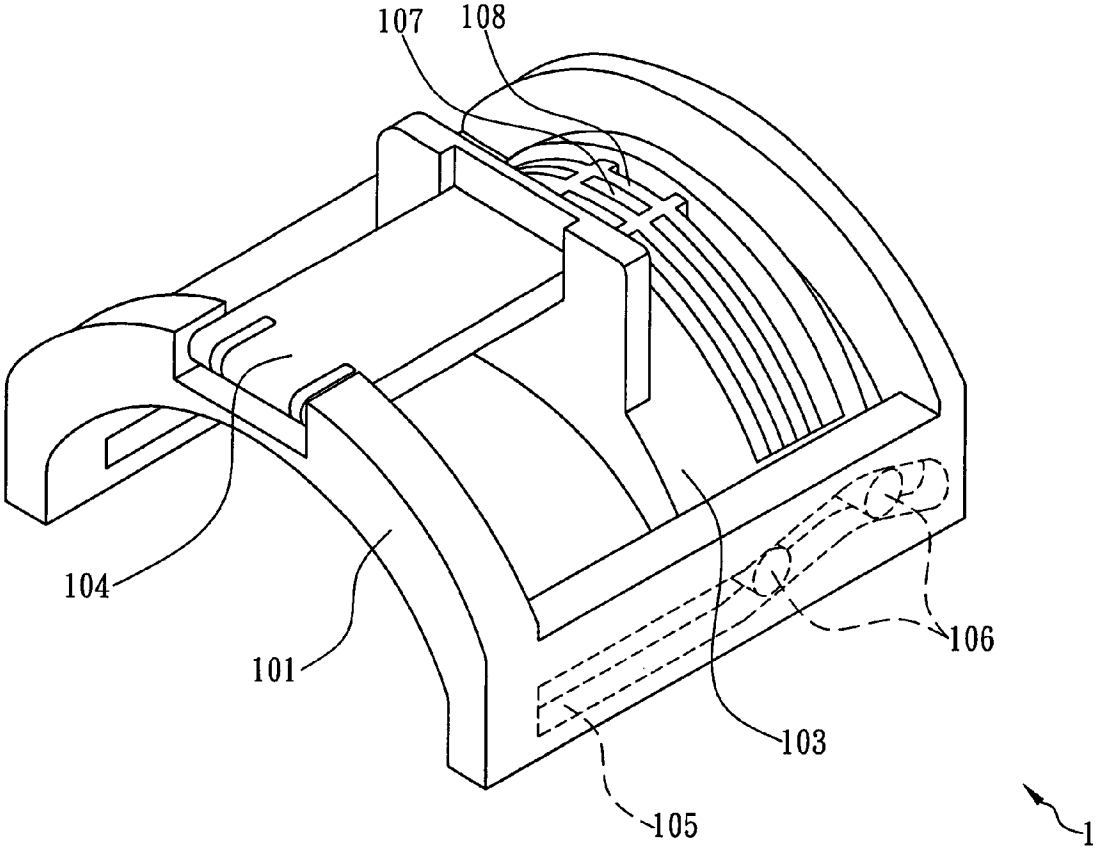
FIG. 2 (Prior Art)
FIG. 2 is a perspective view of an improved structure of an eyelash clamp in accordance with a prior art.
Figure 3:
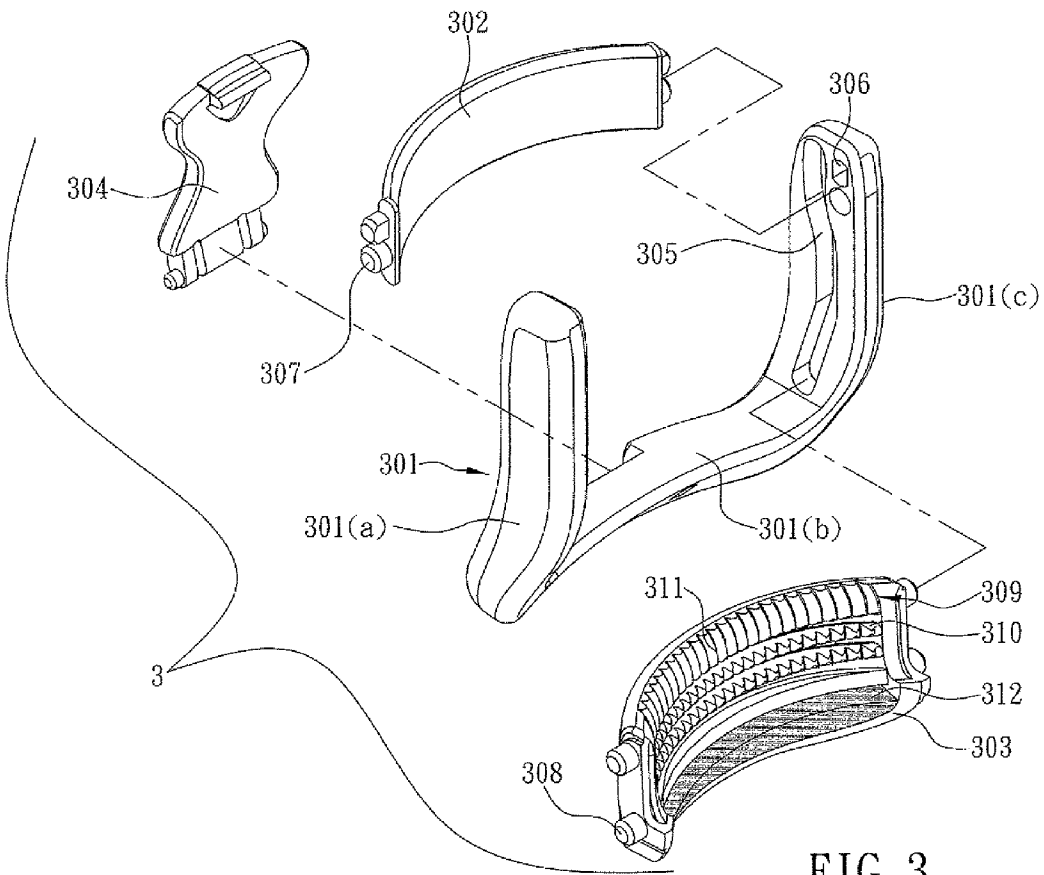
FIG. 3 is a perspective exploded view of an eyelash curling apparatus in accordance with a first preferred embodiment of the present invention.

Referring to FIG. 3 for an eyelash curling apparatus in accordance with a first preferred embodiment of the present invention, the eyelash curling apparatus 3 comprises a frame 301, a curved plate 302, a movable plate 303 and a latch plate 304, wherein the frame 301 is substantially in a U-shape and includes a left portion 301(*a*), a bottom portion 301(*b*) and a right portion 301(*c*), and the left portion 301(*a*) and right portion 301(*c*) are respectively in a curved shape concavely towards a rear side of the frame 301 and the bottom portion 301(*b*) is in a curved shape concavely towards a front side of the frame 301. Inner sides of the left portion 301(*a*) and right portion 301(*c*) correspond to each other and separately include a slide slot 305, and the inner sides of the left portion 301(*a*) and right portion 301(*e*) separately include a fixing hole 306 disposed at a position away from the top edge of the bottom portion 301 (*b*). The curved plate 302 is substantially in a curved shape concavely towards the front side of the frame 301, and both ends separately include an insert portion 307 corresponding to the respective fixing hole 306, such that the curved plate 302 can be fixed to the inner sides of the left portion 301(*a*) and right portion 301(*c*). The movable plate 303 is substantially in a curved shape concavely towards the front side of the frame 301, and both ends separately have at least one protruding lump 308 corresponding to the slide slot 305, such that the movable plate 303 can slide on the frame 301 along the slide slots 305 through the protruding lumps 308, and the movable plate 303 has a plurality of transverse partitions 310 each having a plurality of longitudinal ditch lines 311 disposed on a front surface thereof and a plurality of transverse opening 309 each disposed between two adjacent transverse partitions 310 and extended to positions proximate to both ends of the movable plate 303, and the thickness of the transverse partitions 310 is smaller than the thickness of the movable plate 303. The movable plate 303 includes a clamp pad 312 disposed at a position proximate to a bottom side of the movable plate 303. If the movable plate 303 is moved along the slide slot 305 to a position corresponding to rear surface of the curved plate 302, and front surfaces of the transverse partitions 310 abuts the rear surface of the curved plate 302, and an upper edge of the clamp pad 312 abuts a lower edge of the curved plate 302, such that the eyelash extended between the curved plate 302 and the transverse partitions 310 can be clamped and fixed between the front surfaces of the transverse partitions 310 and the rear surface of the curved plate 302, and the eyelash can be clamped between an upper edge of the clamp pad 312 and a lower edge of the curved plate 302. The latch plate 304 is pivotally coupled to a bottom side of the frame 301. If the movable plate 303 is moved to a position corresponding to the rear surface of the curved plate 302, the latch plate 304 can be turned and latched to the movable plate 303 to maintain the clamp pad 312 and the curved plate 302 in a clamping condition.

In a preferred embodiment of the present invention, a cosmetologist selects a frame 301, a curved plate 302 and a movable plate 303 with an appropriate curvature to fit a consumer's face, when the cosmetologist curls the consumer's eyelash, and the aforementioned components are combined to form the eyelash curling apparatus 3. When the cosmetologist attaches the eyelash curling apparatus 3 onto a consumer's eye socket and extends the eyelash between the curved plate 302 and the transverse partition 310 and pushes the movable plate 303 to a position corresponding to the rear surface of the curved plate 302, such that the eyelash is clamped and fixed between the front surface of transverse partition 310 and the rear surface of the curved plate 302, and also clamped between an upper edge of the clamp pad 312 and an lower edge of the curved plate 302. If the cosmetologist turns the latch plate 304 to press the latch plate 304 against the movable plate 303 to prevent the movable plate 303 from being loosened after the eyelash has been fixed to the eyelash curling apparatus 3, the cosmetologist can coat a curling agent onto the eyelash through the transverse opening 309, and use a heating tool (such as a hair dryer) to increase the temperature of the curling agent for curling the eyelashes. After the eyelashes are fully curled and shaped, the cosmetologist turns the latch plate 304 such that the latch plate 304 is released from the position of the movable plate 303 to push the movable plate 303 away from the position corresponding to the rear surface of the curved plate 302, and further remove the eyelash curling apparatus 3 from the consumer's eye socket. Therefore, the eyelashes can be curled and shaped, and the curliness can be maintained for a long time. Consumers need not to carry the eyelash clamp all the time to reinforce the curliness of the eyelash. Meanwhile, the consumers need not to buy additional eyelash mascara and eyelash brush, and thus can greatly save the time for removing the eyelash mascara, and have no issue of dyeing the eyelash mascara on the eyelids or causing a look of a black eye. Since the cosmetologist can select the frame 301, the curved plate 302 and the movable plate 303 with an appropriate curvature to fit a consumer's face and assemble the aforementioned components into the eyelash curling apparatus 3, the eyelash curling apparatus 3 can be attached closely to a consumer's eye socket to overcome the shortcoming of the traditional eyelash curling apparatus that cannot be attached closely, and also greatly improve the effect of curling the eyelashes.

Figure 4:
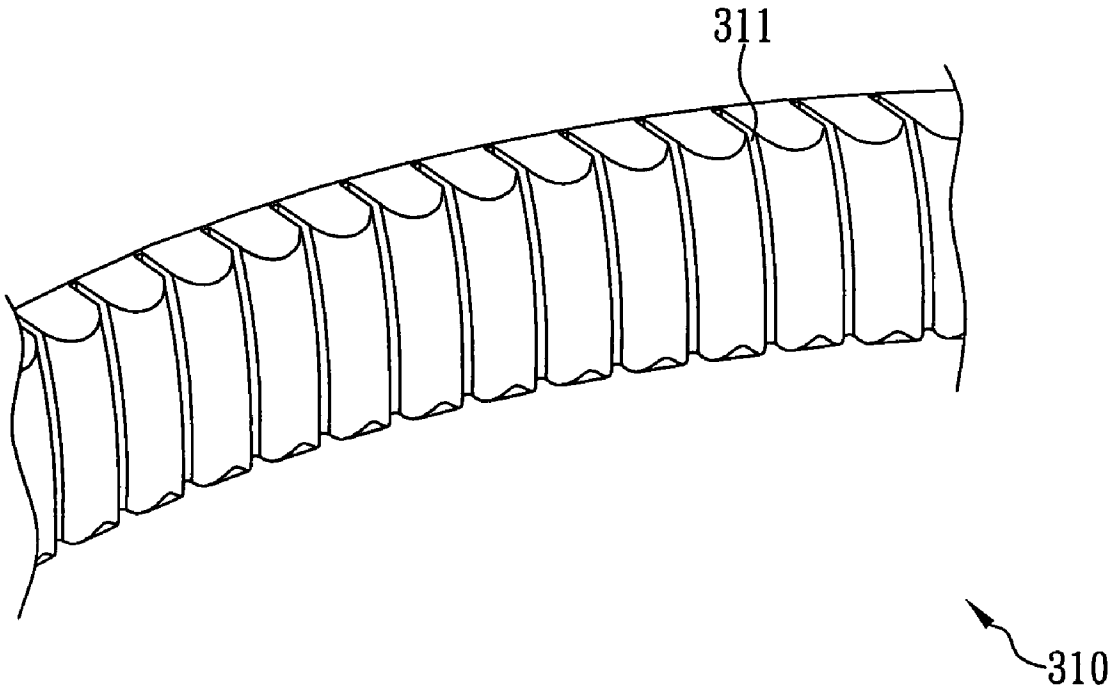
FIG. 4 is an enlarged view of a transverse partition of an eyelash curling apparatus in accordance with a second preferred embodiment of the present invention.

Referring to FIG. 4 for an enlarged view of the transverse partition 310 in accordance with a second preferred embodiment of the present invention, the longitudinal ditch lines 311 are extended on surfaces of the transverse partition 310 proximate to the transverse openings 309 disposed adjacent thereto.

Referring to FIG. 3, the front surface of the transverse partition 310 and both surfaces proximate to transverse openings 309 have the longitudinal ditch lines 311, such that when the cosmetologist coats a curling agent onto a rear surface of the transverse partition 310, the curling agent passes through the transverse openings 309, and then flows to the longitudinal ditch lines 311 and the front surface of the transverse partition 310 to adhere the eyelash evenly, so as to prevent the curling agent from remaining on the rear surface of the transverse partition 310 due to surface tension. With the longitudinal ditch lines 311, the cosmetologist can stick the curling agent easily onto the eyelash through rear surface of the transverse partition 310 and the transverse openings 309, and such arrangement not only effectively avoids a direct contact of the curling agent with the eyelids or eyeballs, but also prevents allergies to the eyelids or eyeballs caused by the curling agent. With the longitudinal ditch lines 311, the eyelashes can be combed, and after the cosmetologist uses the curling agent to curl the eyelashes, the eyelashes can be combined into fine hairs and the curliness can be maintained for a long time.

Figure 5:
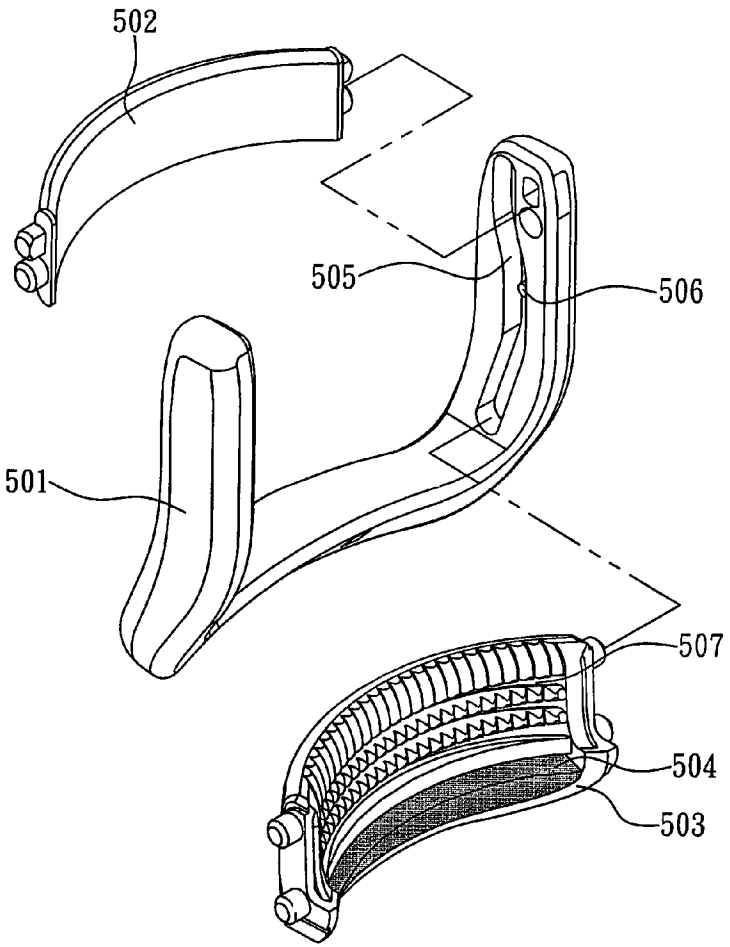
FIG. 5 is a perspective view of an eyelash curling apparatus in accordance with a third preferred embodiment of the present invention.

Referring to FIG. 5 for a latch portion protruded from each slide slot in accordance with a third preferred embodiment of the present invention, a latch portion 506 is protruded from each slide slot 505 of the frame 501. If the movable plate 503 is moved to a position corresponding to a rear surface of the curved plate 502, the latch portion 506 can be latched and pressed against the movable plate 503, so that the clamp pad 504 and the curved plate 502 can be maintained at a clamping condition to prevent the movable plate 503 from being loosened, and the cosmetologist can coat the curling agent onto the eyelashes through the transverse opening 507 successfully.

The present invention has been described with preferred embodiments thereof and it is understood that many changes and modifications to the described embodiment can be carried out without departing from the scope and the spirit of the invention that is intended to be limited only by the appended claims.

What is claimed is:

1. An eyelash curling apparatus, comprising:

a frame, being substantially in a U-shape and including a left portion, a bottom portion and a right portion, wherein the left portion and right portion are respectively in a curved shape concavely towards a rear side of the frame and the bottom portion is in a curved shape concavely towards a front side of the frame, inner sides of the left portion and right portion correspond to each other and have a slide slot respectively, the slide slot includes a latch portion protruded from the slide slot, and the inner sides of the left portion and right portion have a fixing hole disposed at a position away from a top edge of the bottom portion respectively;

a curved plate, being in a curved shape concavely towards the front side of the frame, wherein both ends of the curved plate have an insert portion corresponding to the fixing hole respectively, such that the curved plate can be fixed to the inner sides of the left portion and right portion at a position away from the top edge of the bottom portion; and a movable plate, being in a curved shape concavely towards the front side of the frame, wherein both ends of the movable plate have at least one protruding lump corresponding to the slide slot respectively, such that the movable plate can slide on the frame along the slide slots by means of the protruding lumps, the movable plate includes a plurality of transverse partitions each having a plurality of longitudinal ditch lines disposed on a front surface thereof and a plurality of transverse opening each disposed between two adjacent transverse partitions and extended to positions proximate to both ends of the movable plate, the thickness of the transverse partition is smaller than the thickness of the movable plate, and a clamp pad is disposed on the movable plate at a position proximate to a bottom side of the movable plate, such that when the movable plate is moved along the slide slot to a position corresponding to a rear surface of the curved plate, an upper edge of the clamp pad abuts a lower edge of the curved plate, and the latch portion latches and abuts the movable plate to maintain the clamp pad and the curved plate in a clamping condition.

2. The eyelash curling apparatus of claim 1, wherein the longitudinal ditch lines are extended to surfaces of the transverse partition proximate to the transverse openings.

* * * * *